United States Patent [19]

Hansen

[11] Patent Number: 5,060,396

[45] Date of Patent: Oct. 29, 1991

[54] ZONED CYLINDRICAL DRYER

[75] Inventor: Dennis L. Hansen, DePere, Wis.

[73] Assignee: W. R. Grace & Co.-Conn., Lexington, Mass.

[21] Appl. No.: 395,440

[22] Filed: Aug. 17, 1989

[51] Int. Cl.[5] ..... F26B 5/04

[52] U.S. Cl. ..... 34/16; 34/156; 34/155; 34/209

[58] Field of Search ..... 34/23, 32, 215, 216, 34/217, 155, 156, 242, 16, 209, 51

[56] References Cited

U.S. PATENT DOCUMENTS

| | | | |
|---|---|---|---|
| 3,728,074 | 4/1973 | Victor . | |
| 4,012,847 | 3/1977 | Rand . | |
| 4,128,947 | 12/1978 | Jackson . | |
| 4,255,037 | 3/1981 | Meadows et al. | 34/242 X |
| 4,321,757 | 3/1982 | Van Der Blom | 34/23 |
| 4,406,388 | 9/1983 | Takash et al. | 34/156 X |
| 4,464,845 | 8/1984 | Bubelo et al. . | |
| 4,513,590 | 4/1985 | Fine . | |
| 4,530,165 | 7/1985 | Tiedemann . | |
| 4,729,177 | 3/1988 | Vecchia . | |
| 4,823,479 | 4/1989 | Dornier et al. . | |
| 4,844,743 | 7/1989 | Koblenzer et al. . | |

*Primary Examiner*—Henry A. Bennet

*Attorney, Agent, or Firm*—Hugh D. Jaeger

[57] ABSTRACT

A dryer used to remove a flammable solvent or vapors from a traveling web of material supported in flotation by opposing air bars. The dryer consists of a large metallic cylinder through which the web of material moves longitudinally. Seals in the ends of the metallic cylinder at the point of entry and point of exit of the traveling web provide for a control system to maintain the desired environment under controlled pressure within the metallic cylinder. The web of material travels successively through one or more zones within the metallic cylinder. In each drying zone, the web of material is exposed to pressurized atmosphere at predetermined temperatures. The solvent is recovered from the pressurized atmosphere by rapid cooling, membrane separation, or absorption. Sensors within each zone of the dryer measure the oxygen content of the pressurized atmosphere. If the oxygen content exceeds a given threshold, pressurized nitrogen or other inert gas is added. Through the use of a carbon bed at the last zone, pressurized atmosphere from that zone is rendered sufficiently free of solvent to be exhausted to the air or to a nitrogen recovery unit, thereby maintaining the desired overall pressure within the metallic cylinder.

14 Claims, 16 Drawing Sheets

ZONED CYLINDRICAL DRYER

This application relates to co-pending U.S. patent application Ser. No. 07/395,429, filed Aug. 17, 1989, entitled "Control System for an Industrial Dryer", by Norz et al. and assigned to the same assignee.

BACKGROUND OF THE INVENTION

1. Field of the Invention

The present invention relates generally to dryers, and more particularly, relates to a round cylindrical industrial dryer employing a controlled environment system for the recovery of flammable solvents. A traveling web of material is floated by opposing air bars.

2. Background of the Invention

It is known in the prior art that processes which involve flammable vapors must often be accomplished in sealed chambers. It is also particularly important to protect operators and other workers in the area from dangers associated with inhaling certain solvents. In the past, most of these chambers have been rectangular in shape. Though this shape is convenient for some purposes, fabrication tends to be difficult and expensive. Rectangular structures are more prone to weld or stress cracks.

U.S. Pat. No. 4,826,707 issued to Schwarz et al. on May 2, 1989, shows such a sealed chamber in a cylindrical shape. The process taught by Schwarz et al. is the coating of a web of material while cooling the material to avoid structural damage. The environment of the chamber of Schwarz et al. is easily controlled because the entire web of material undergoing processing is contained within the sealed chamber.

At times, however, it is desirable to process a continuous web of material of considerably greater volume than can be practically contained within the sealed chamber. Therefore, a continuous web of material must travel through the chamber making it difficult to control the atmosphere within the chamber. The most common technique is through the use of an inert gas to backfill the chamber at a pressure which is slightly greater than atmospheric pressure. This permits the maximum control of the environment within the chamber.

The interior of the cylinder of Schwarz et al. consists of a single processing chamber. This is disadvantageous when the process to be accomplished is a drying operation because it restricts the process to an atmosphere of single temperature, pressure, and composition. Use of a number of chambers as taught by Schwarz et al. is possible, but tends to be expensive and is much more likely to leak.

When the process involves the release of a flammable vapor, such as the removal of a flammable solvent vapor, great care must be exercised in maintaining a low oxygen level within the sealed chamber. A common prior art technique is to purge the entire chamber when the oxygen level exceeds a predetermined threshold level. This often results in unacceptable down time of the process and unacceptable waste of the inert gas used to backfill the chamber. Such purging may itself present a safety risk because the contents of the chamber often cannot simply be vented to the air.

The present invention overcomes the disadvantages of the prior art by providing a zoned cylindrical dryer for removing solvents from a traveling web floated by a plurality of air flotation bars or like support structure.

SUMMARY OF THE INVENTION

The general purpose of the present invention is a substantially sealed dryer including a number of drying zones. The use of multiple drying zones is desirable because it permits the use of successively lower solvent vapor concentrations. The present invention is a vast improvement over multiple single chamber cylinders because its separate drying zones may leak to one another, but may not leak directly to the air.

The overall shape of the dryer is cylindrical. This improves convenience of fabrication and tends to be easily maintained. The cylindrical shape minimizes the number of welds and tends to evenly distribute stress and allow for expansion under changing temperatures. The cylindrical shape also enhances purging and collection of condensation.

A plurality of opposing air bars or suitable support structure is located in each of the drying zones for supporting a continuous traveling web of material which passes through the cylinder through optional pressure seals. Each successive drying zone removes additional solvent.

Oxygen sensors are strategically positioned within each of the drying zones to monitor the oxygen level within the corresponding drying zone. Upon approaching a predetermined oxygen level threshold, nitrogen or other inert gas is automatically added to the environment of the drying zone to maintain the oxygen at a safe lower limit level.

The last drying zone can utilize a carbon bed to filter the atmosphere. The output of the carbon bed contains so little solvent that the output can be safely vented directly to the air or used to pressurize optional seals. This venting occurs as nitrogen is added to maintain the overall pressure within the cylinder to a predetermined range.

One significant aspect and feature of the present invention includes a zoned cylindrical dryer which provides for drying of a traveling web of material and vapor solvent removal from the drying atmosphere circulated through each zone.

Another significant aspect and feature of the present invention is a zoned dryer for use in the graphic arts industry, the coating industry, and other applications to dry a web.

Having thus described the embodiments of the present invention, it is a principal object hereof to provide a zoned cylindrical dryer for drying a traveling web of material.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
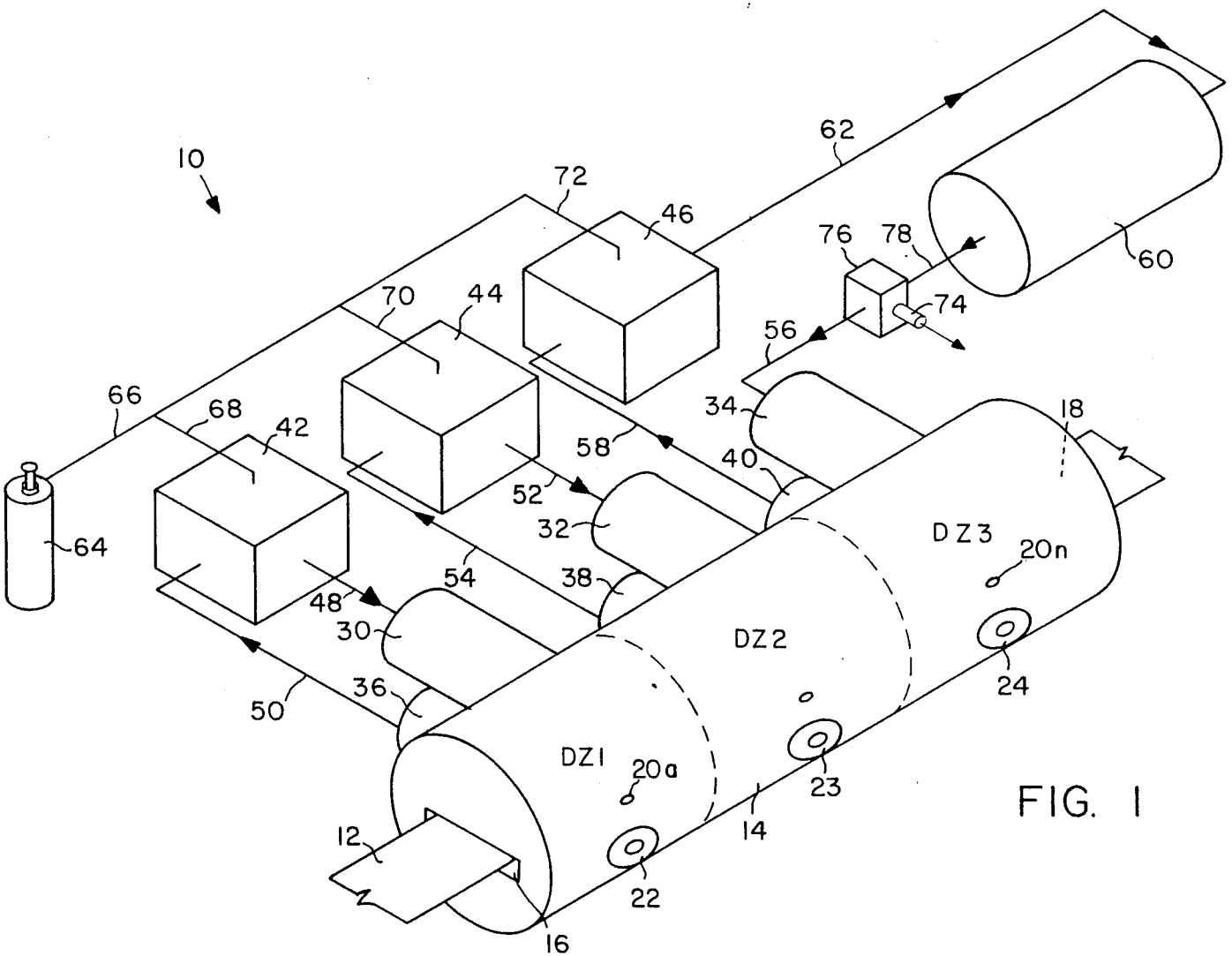
FIG. 1 illustrates a perspective view of a zoned cylindrical dryer, the present invention.

FIG. 1 illustrates a perspective view of an industrial cylindrical dryer 10 of the present invention. The industrial cylindrical dryer 10 is employed to remove any solvents such as hexane from the material of a traveling web 12. The traveling web 12 enters a sealed cylinder 14 at optional entry seal 16 and exits the sealed cylinder 14 at optional exit seal 18. In one preferred mode of operation, the industrial cylindrical dryer 10 utilizes three drying zones, although one with skill in the art can apply the teachings disclosed herein to dryers having any plurality of drying zones. Each of the three drying zones is viewed through corresponding glass enclosed air tight windows 20*a*–20*n*. Door 22 corresponds to drying zone one "DZ1". Similarly, door 23 corresponds to drying zone two "DZ2", and door 24 corresponds to drying zone three "DZ3". The dryer structure is made of metal and any other suitable material can be utilized in the manufacturing process.

DZ1 receives treated, pressurized atmosphere via supply duct 30. This treated, pressurized atmosphere is directed by internal air bars to the material of traveling web 12 passing through DZ1. Return duct 36 evacuates atmosphere from DZ1 and returns it to condensing unit 42 through the path 50. Through the use of heating and cooling coils, condensing unit 42 condenses the hexane solvent and returns it to the recovery area which is not illustrated. The remaining atmosphere is again pressurized and returns to DZ1 via path 48 and supply duct 30.

DZ2 receives treated, pressurized atmosphere via path 52 and supply duct 32 from condensing unit 44. DZ2 is exhausted by supply duct 38 and path 54.

DZ3 exhaust is channeled via return duct 40 and path 58 to condensing unit 46. Following condensation, the atmosphere is sent via path 62 to carbon bed 60 for filtering. After filtering, the treated, pressurized atmosphere is returned to DZ3 via paths 56 and 78 and the supply duct 34. However, after filtering, the output of carbon bed 60 is sufficiently free of solvent to be vented directly to the air. This is done by control valve 76 and vent stub 74 whenever the system determines that venting is necessary to maintain the overall pressure of sealed cylinder 14 within the predetermined limits.

Pressurized nitrogen is stored in storage tank 64. It may be supplied via path 66 to DZ1, DZ2, and DZ3 via paths 68, 70 and 72, respectively. An oxygen sensor within each of the three zones constantly monitors the oxygen level within the corresponding drying zone. Whenever the oxygen level exceeds a predetermined level, nitrogen is automatically added to that zone to maintain its environment at a safe level.

Figure 2:
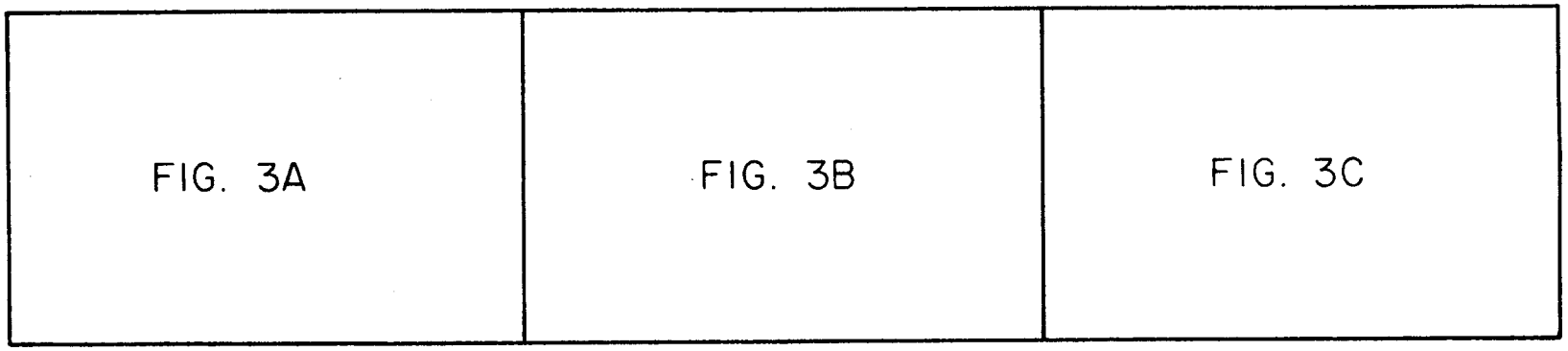
FIG. 2 illustrates the layout of FIGS. 3A–3C.
Figure 3A:
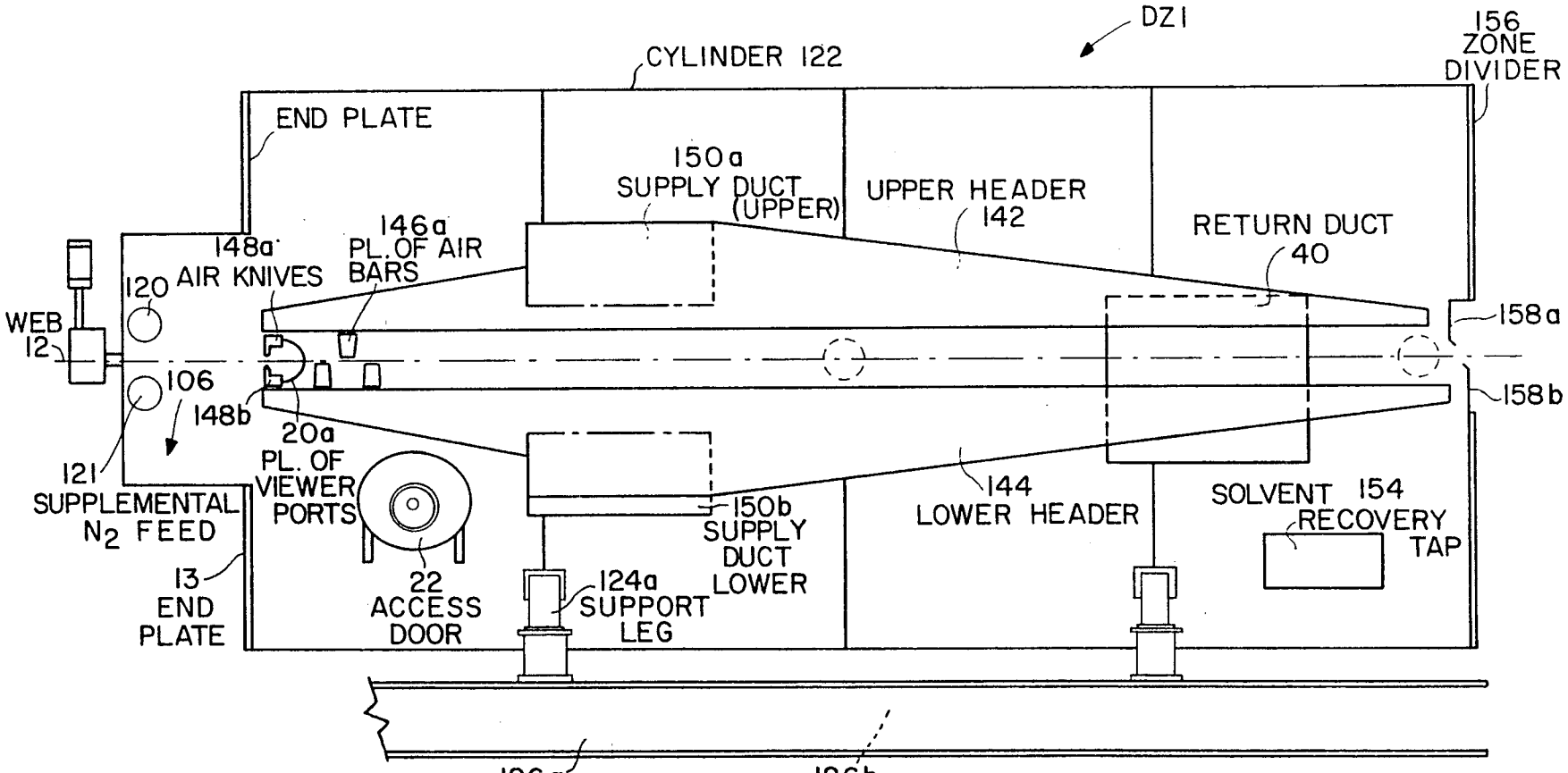
FIGS. 3A–3C illustrates a cross-sectional view of a three zoned dryer.
Figure 3B:
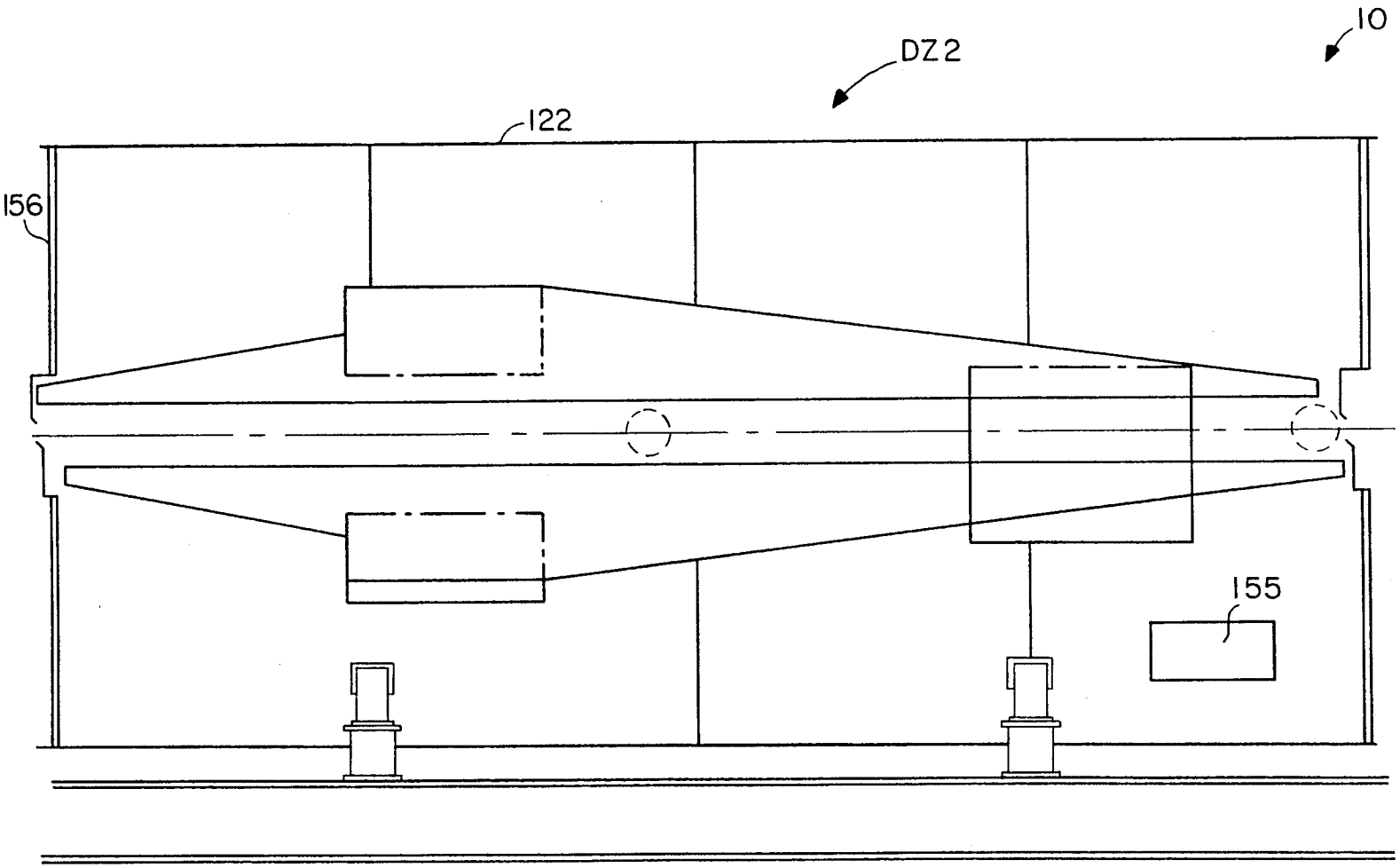
Figure 3C:
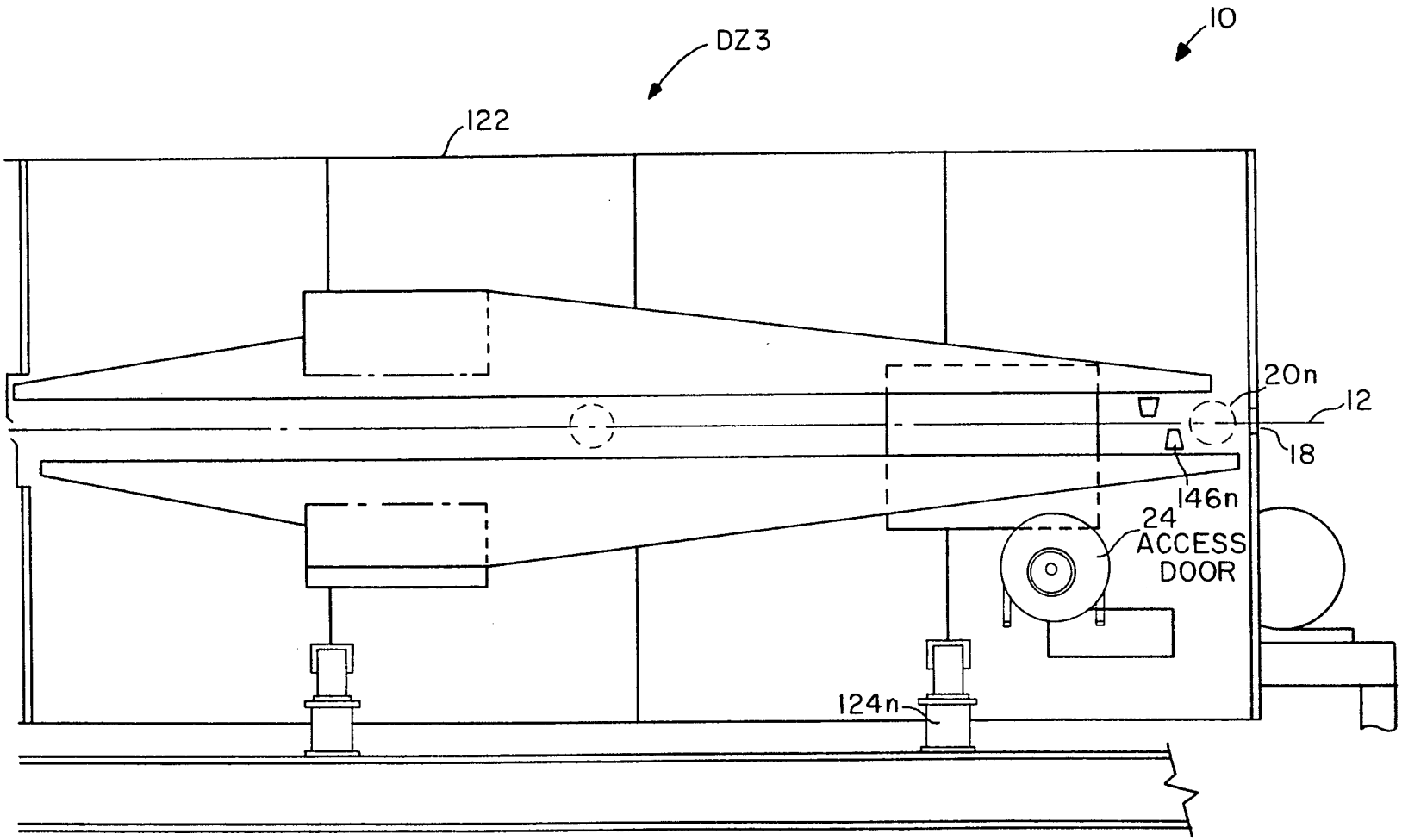

FIG. 2 illustrates the layout of the drawings of FIGS. 3A–3C.

FIGS. 3A–3C illustrate a cross-sectional view of a three zoned cylindrical dryer. The figures are arranged according to FIG. 2. Three pairs of opposing air bars are positioned in each of the three zones of the dryer for flotation of a traveling web 12 of material. Other support structure for supporting the traveling web can be utilized in lieu of the air bars. The zones are separated by zone divider assemblies as later described in detail in FIG. 8. An optional gas seal is provided on one end of the dryer. The dryer is supported on a plurality of feet, where some of the feet are anchored and other feet are in a sliding arrangement to permit for thermal expansion on all axes and contraction of the dryer structure during heating and cooling thermal cycles.

FIG. 3A illustrates the inlet zone DZ1 of the industrial cylindrical dryer 10 including the gas seal structure 106. The industrial cylindrical dryer 10 has a cylindrical member 122 such as a cylindrical tube supported on legs 124*a*–124*n* which can be supported on channels 126*a* and 126*b*. Depending upon the specifications, length and size of the industrial cylindrical dryer 10, some of the legs 124*a*–124*n* are anchored and others are placed in a movable track relationship for the heating and cooling thermal cycles of the structure. An end plate 13 encloses about the gas seal structure 106. A plurality of viewing ports, such as glass enclosed air tight windows 20*a*–20*n* are provided along the longitudinal length of the cylinder 122. Access doors 22, 23, and 24 in FIGS. 3A and 3C are provided to gain access to a cat walk internal to the cylinder 122. The gas seal structure 106 is positioned at the entrance of the dryer, and supplemental inert gas feed ducts 120 and 121.

Air flotation bars are supported in a center portion of the cylinder 122 and include an upper header 142, a lower header 144, a plurality of air bars 146*a*–146*n*, and air knives 148*a*–148*b*. The air flotation bars of the present invention are similar in structure to the air bars such as in representative U.S. Pat. No. 3,739,491, assigned to the same assignee as the present invention. Ducts 150*a* and 150*b* supply atmosphere to the supply ducts, and duct 140 is a return duct. A solvent recovery tap 154 connects to the solvent recovery system as later described in detail. Zone divider assembly 156, as later described in FIG. 8, separates the inlet zone from the center zone of the dryer. Baffles 158*a* and 158*b* secure to the zone divider assembly 156 for passage of the web. The cylinder of the dryer can include stiffeners as may be required depending upon the thickness of the material, the diameter of the cylinder and the length of the cylinder; these are not shown for purposes of brevity in the drawings. One of the objects of the invention is to maintain a fixed pressure relative to the atmosphere within the cylinder and provide an optional gas seal at the inlet end and a minimum clearance at the baffles 158*a* and 158*b* forming a web slot to maintain the inert atmosphere and/or the upper explosive limit at a predetermined level.

FIG. 3B illustrates the center drying zone DZ2 and the ends overlap the structure of FIGS. 3A and 3C. The structure is similar to that of FIG. 3A, and for the sake of brevity in the specification, a detailed description will not be repeated.

FIG. 3C illustrates the outlet drying zone DZ3 similar in structure to that of DZ1 and DZ2 of FIGS. 3A and 3B. For the sake of brevity in the specification, a detailed description will not be repeated.

Figure 4:
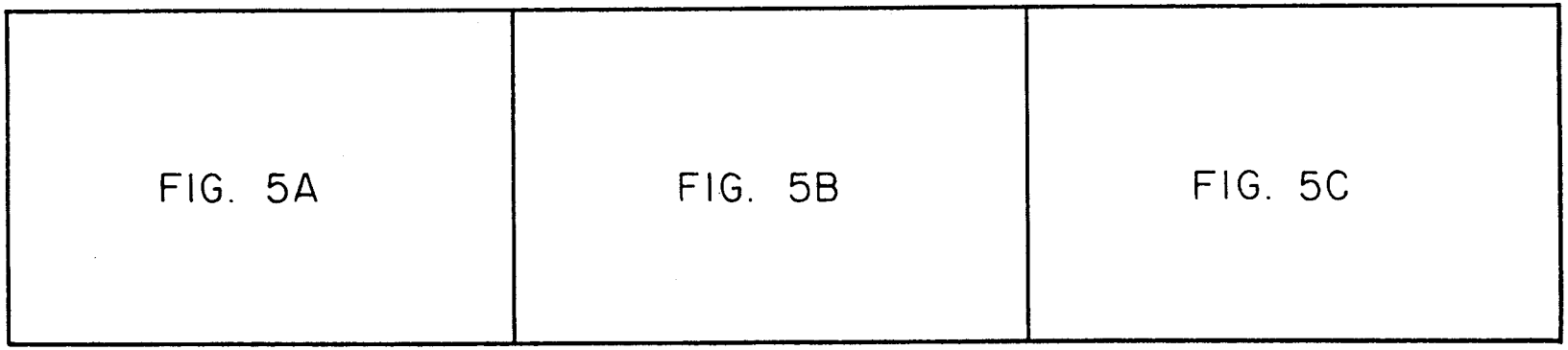
FIG. 4 illustrates the layout of FIGS. 5A–5C.
Figure 5A:
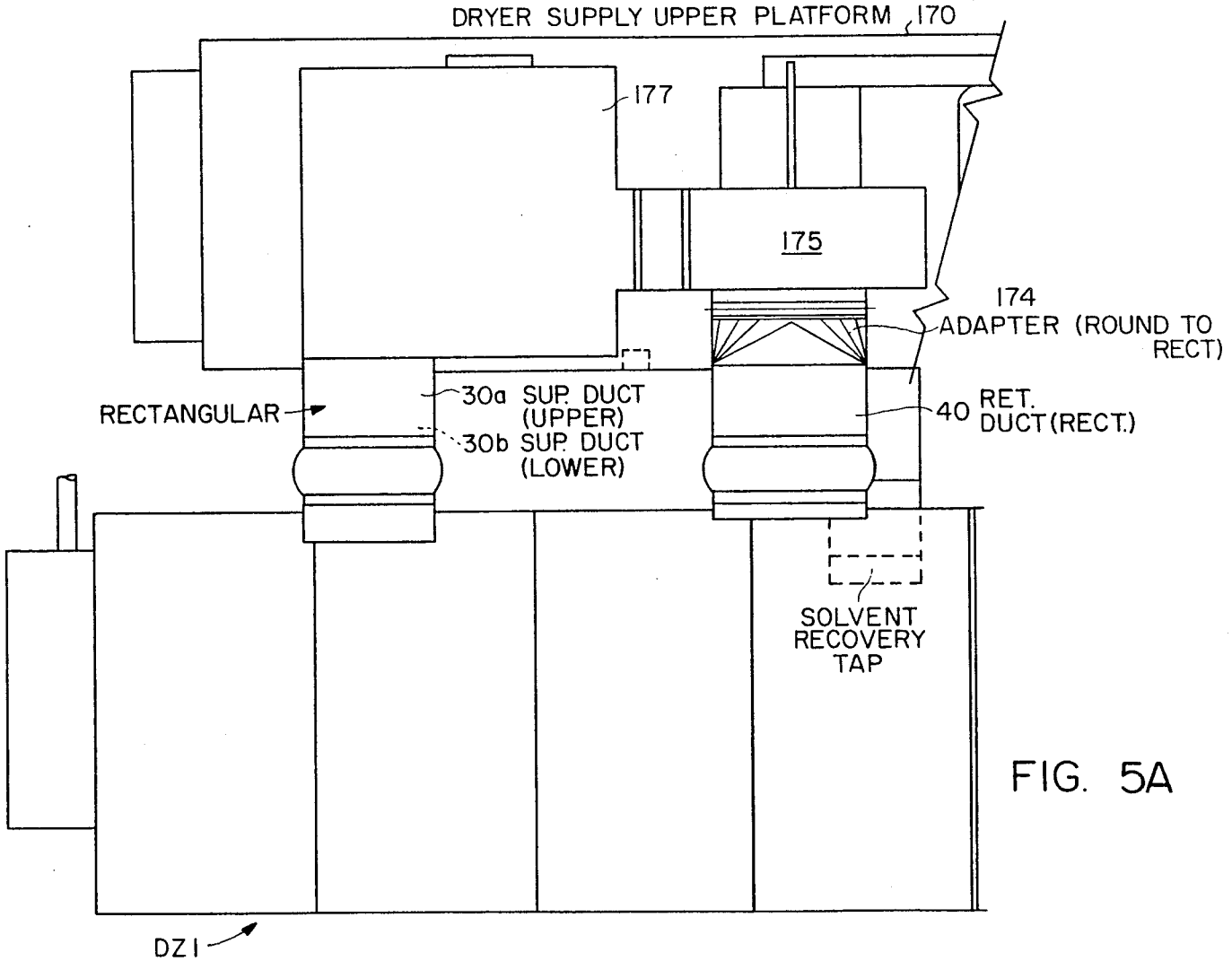
FIGS. 5A–5C illustrates a top view of the dryer.
Figure 5B:
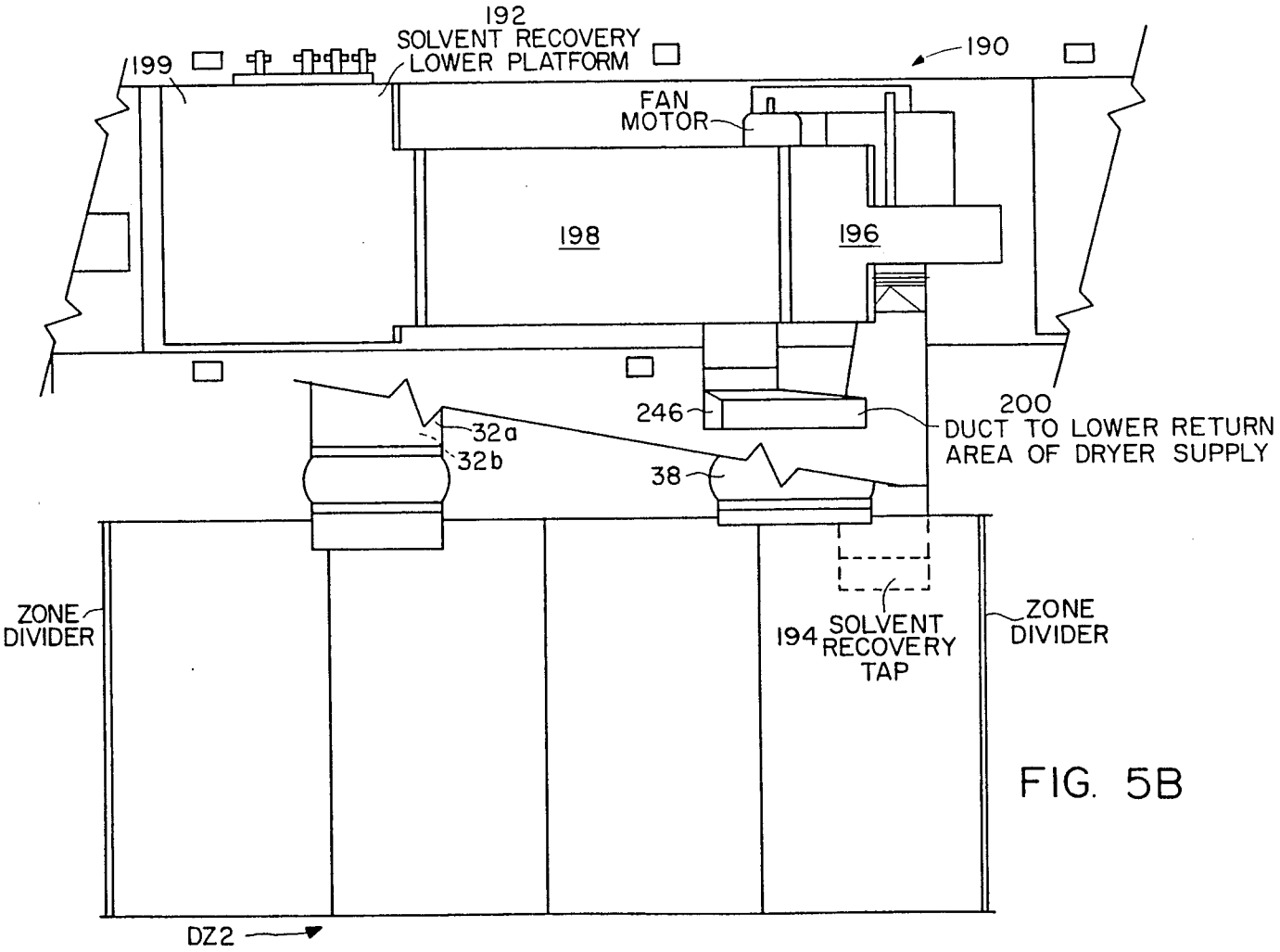
Figure 5C:
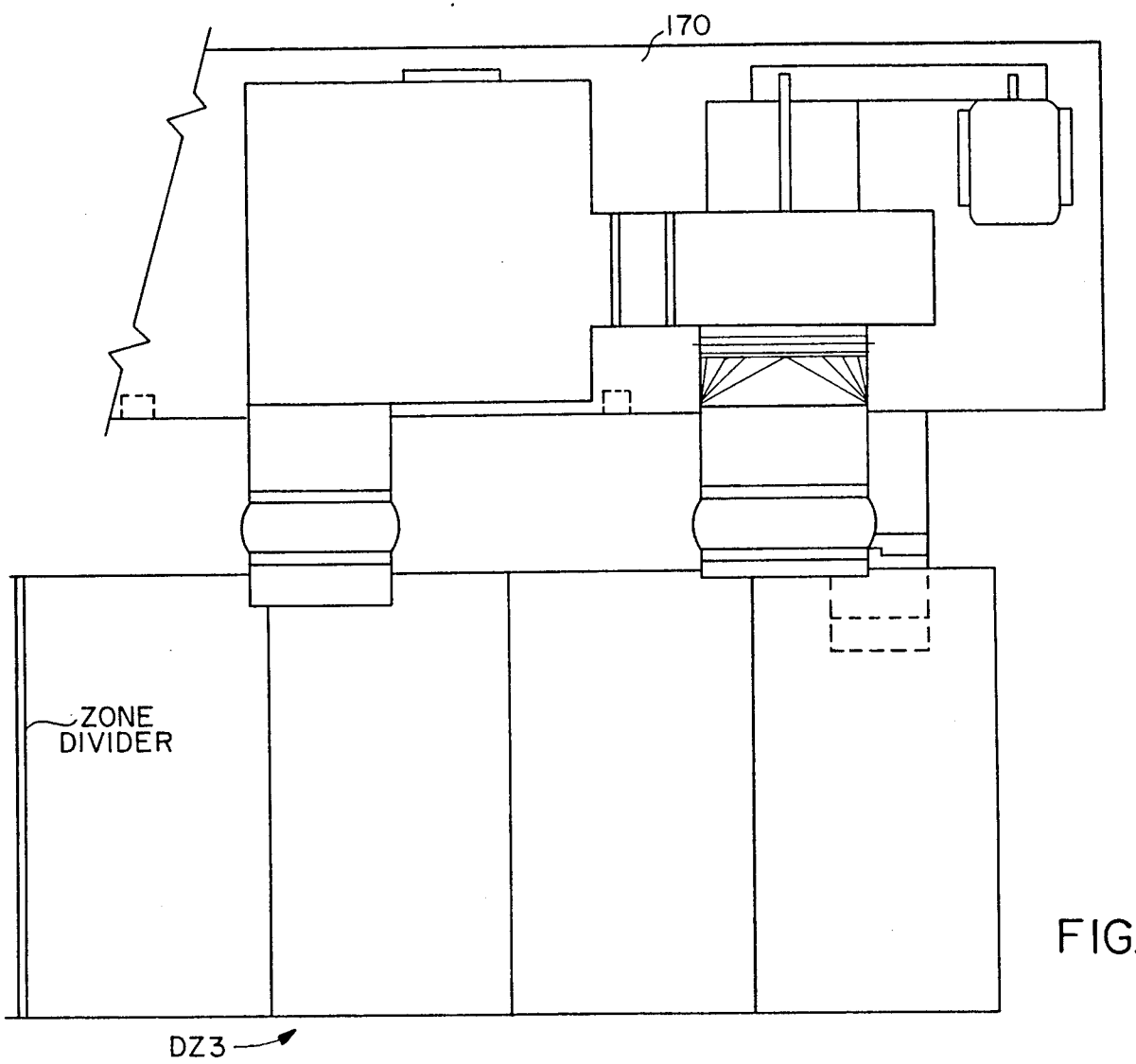

FIG. 4 illustrates the layout of the drawings of FIGS. 5A–5C.

FIGS. 5A–5C illustrates a top view of the industrial cylindrical dryer 10 including views of the dryer supply upper platform and the solvent recovery lower platform.

FIG. 5A illustrates a top view of the DZ1 and a top view of the dryer supply upper platform 170 including a return duct 40, an adapter 174, a fan 175, a plenum 177, and upper and lower supply ducts 30*a* and 30*b*. The ducts are joined to the dryer with flexible joints. The structure internal to the dryer, as well as the accompanying electromechanical structure, is described in the co-pending patent application.

FIG. 5B illustrates a top view of the DZ2 and a top view of the lower platform 192 of the solvent recovery structure 190. The solvent recovery lower platform 192 is shown along the breakaway sectional lines. The solvent recovery structure 190 includes upper and lower supply ducts 32*a* and 32*b*, a solvent recovery tap 194, a fan 196, a heat exchanger 198, a plenum 199, and a duct 200 to the lower return duct area of the dryer supply.

FIG. 5C illustrates a top view of the DZ3 and of a dryer supply upper platform 170. The dryer supply upper platform 170 is a similar structure as previously described for DZ1.

Figure 6:
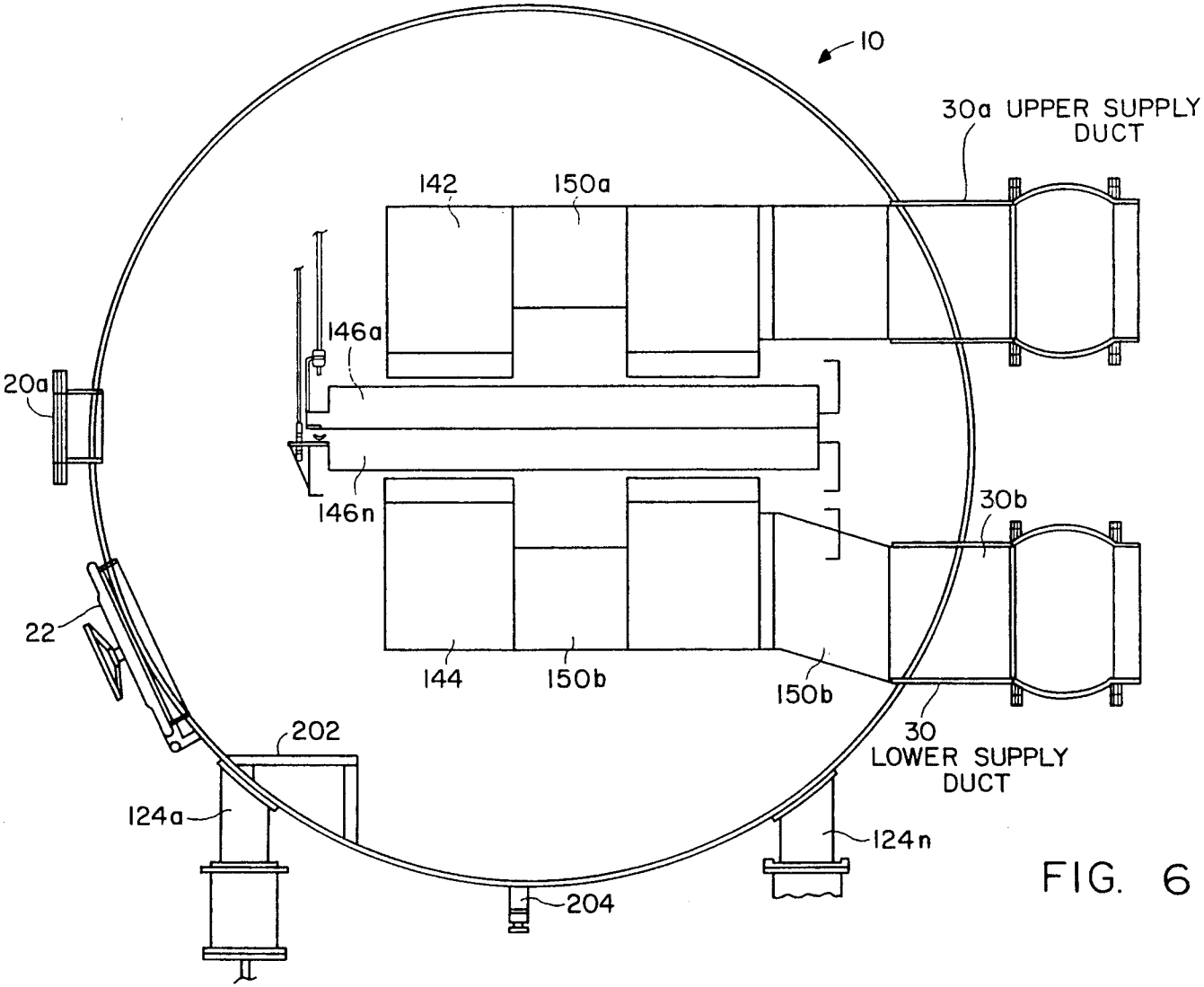
FIG. 6 illustrates a cross-sectional view of a zone of the dryer.

FIG. 6 illustrates a cross-sectional view of DZ1 of the industrial cylindrical dryer 10, as seen through DZ1, illustrating the air flotation bars 146*a*–146*n* with the supply ducts 30*a* and 30*b* and headers 142 and 144. The legs 124*a*–124*n* are illustrated for supporting the cylinder of the dryer. A walking platform 202 extends throughout the length of the dryer. At least one drain outlet is provided in the bottom of each zone of the dryer. All other numerals correspond to those elements previously described.

Figure 7:
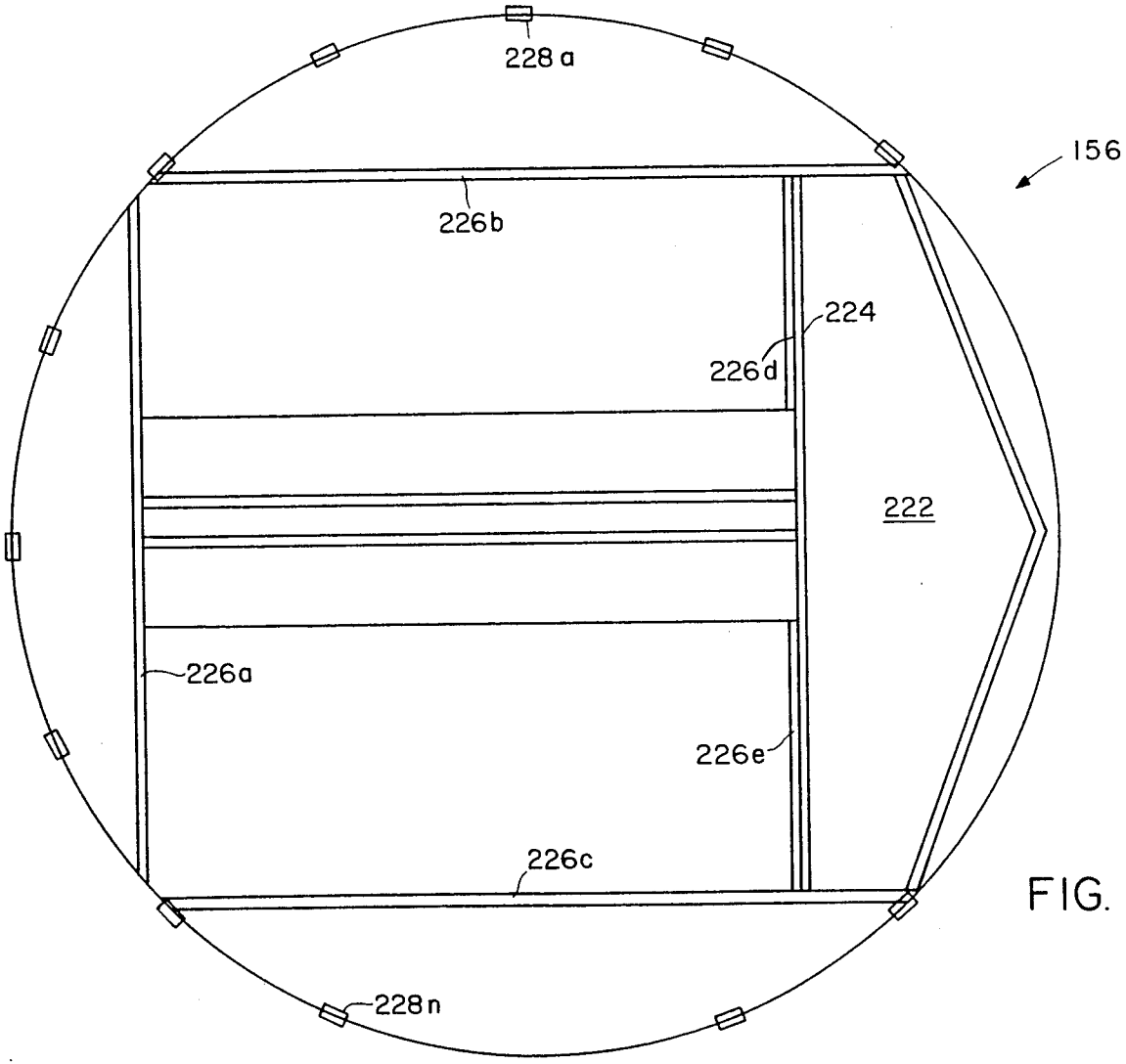
FIG. 7 illustrates a zone partition assembly.

FIG. 7 illustrates a Zone divider 156 including a door 222, a hinge 224, and appropriate angles 226*a*–226*n*. Tabs 228 provide for securing of the zone assembly between the zone sections of the dryer cylinders. Such zone dividers provide the inter drying zone seal which enables each drying zone to be supplied by a different atmosphere handling system. In that way, each drying zone can be operated at a different temperature, pressure and solvent vapor composition.

Figure 8:
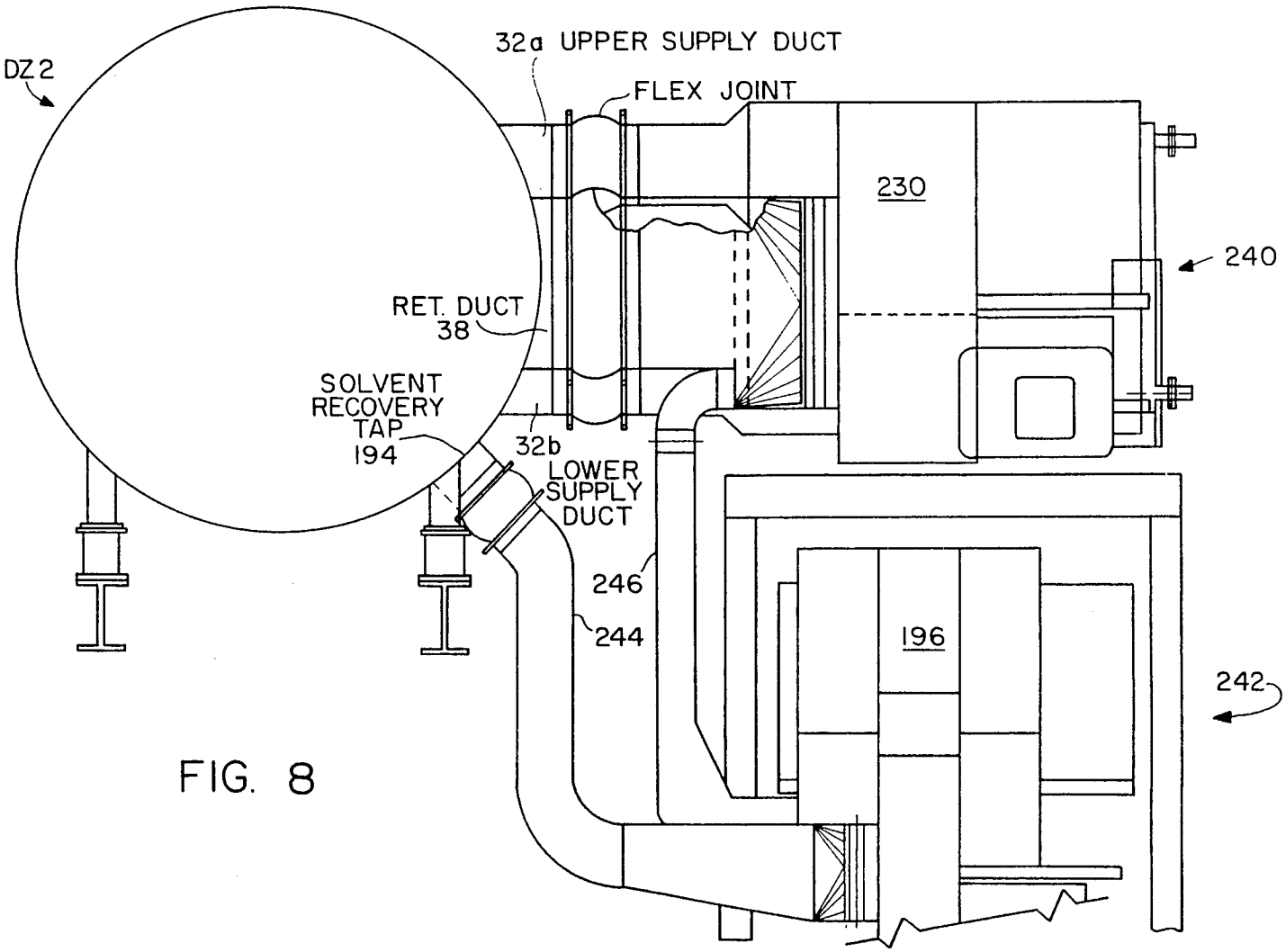
FIG. 8 illustrates a plane view of the equipment layout for the dryer supply and the solvent recovery.

FIG. 8 illustrates a plan view of the equipment layout for the dryer supply and solvent recovery in drying zone DZ2. The solvent recovery in partial section is further illustrated and described in detail in FIG. 11. All other numerals correspond to those elements previously described. Particularly illustrated is the atmosphere loop containing solvent recovery tap 194, fan 196, return duct 246 and duct 244.

Figure 9:
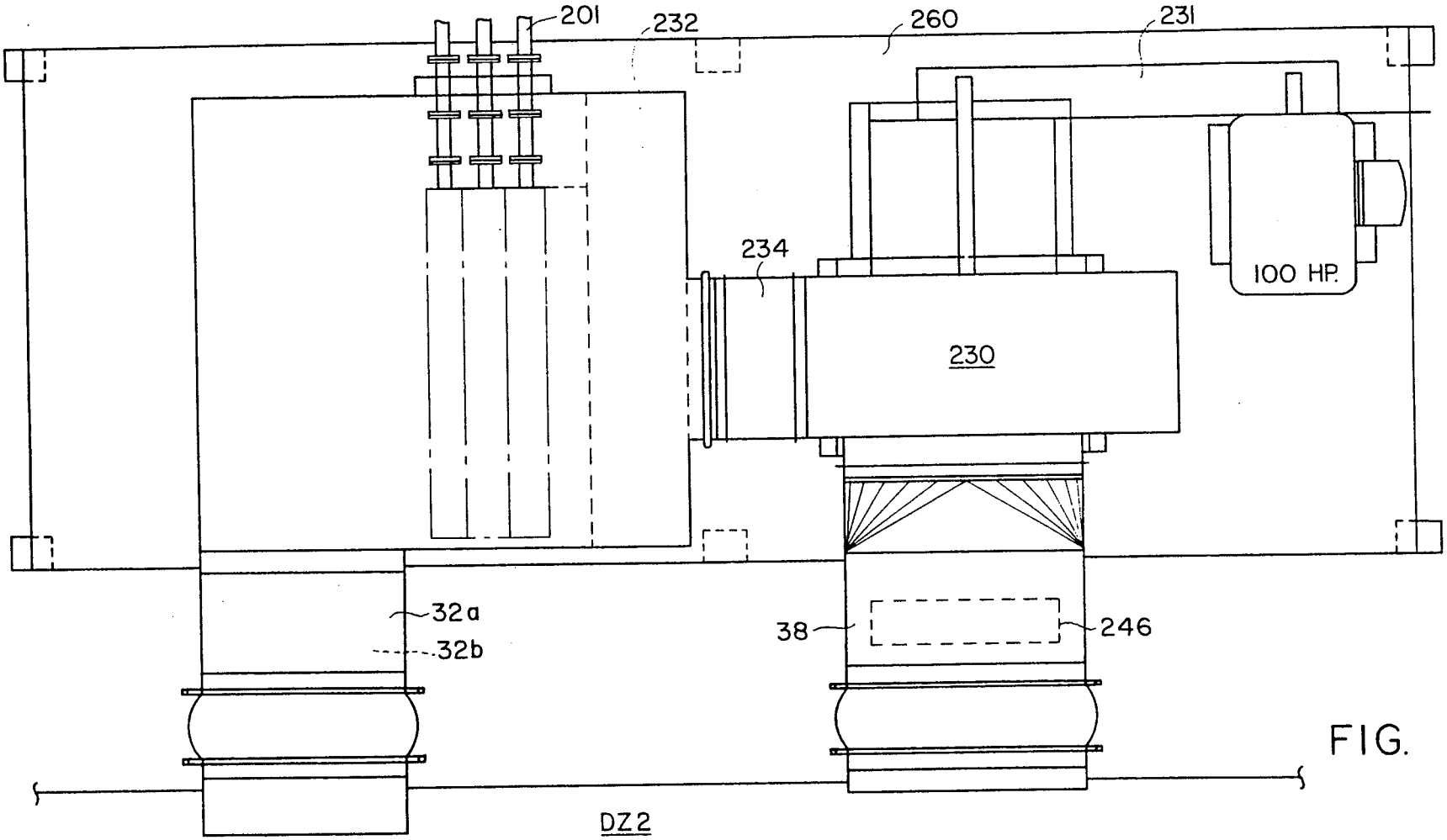
FIG. 9 illustrates a top view of the dryer supply.

FIG. 9 illustrates a top view of the dryer supply adjacent to DZ2 including a supply platform 260, the fan drive 231, inlet duct 38, heating coil 201, and plenum 232.

Figure 10:
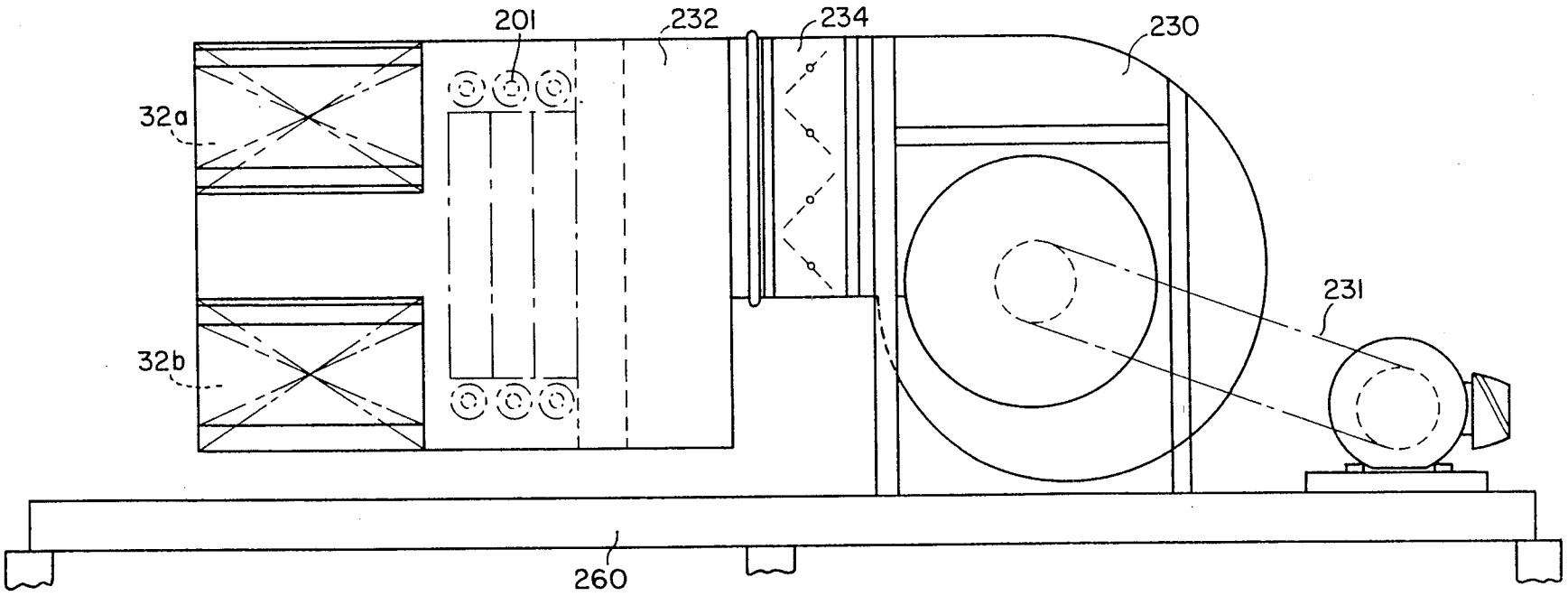
FIG. 10 illustrates a side view of the dryer supply.

FIG. 10 illustrates a side view of the dryer supply where all numerals correspond to those elements previously described.

Figure 11:
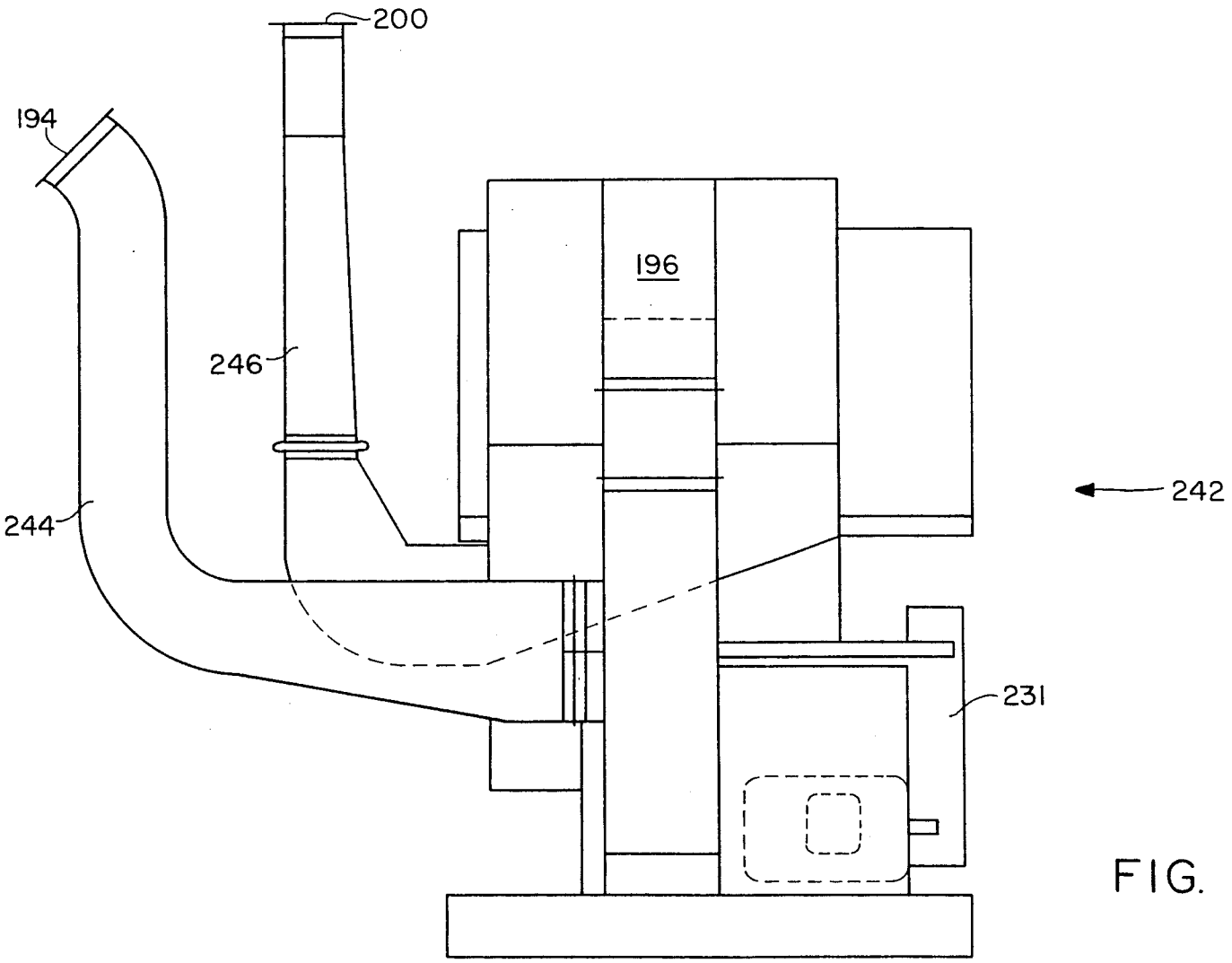
FIG. 11 illustrates an end view of the solvent recovery.

FIG. 11 illustrates an end view of the solvent recovery system including the inlet duct 244 and the return duct 246.

Figure 12:
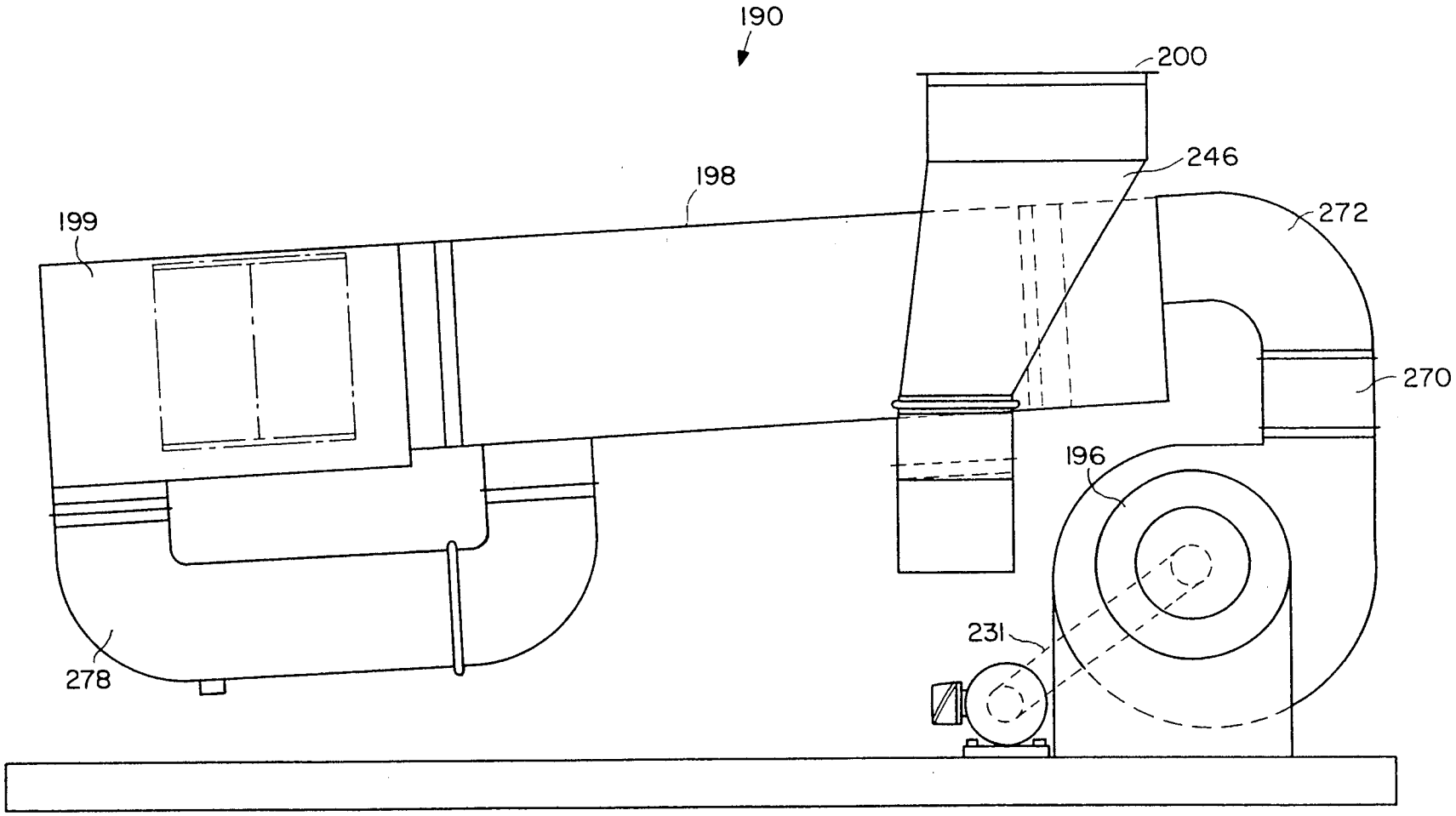
FIG. 12 illustrates a side view of the solvent recovery.

FIG. 12 illustrates a side view of the solvent recovery structure 190 including a damper 270, an entry duct 272, a heat exchanger 198, a plenum 199, and a recovery duct 278.

Figure 13:
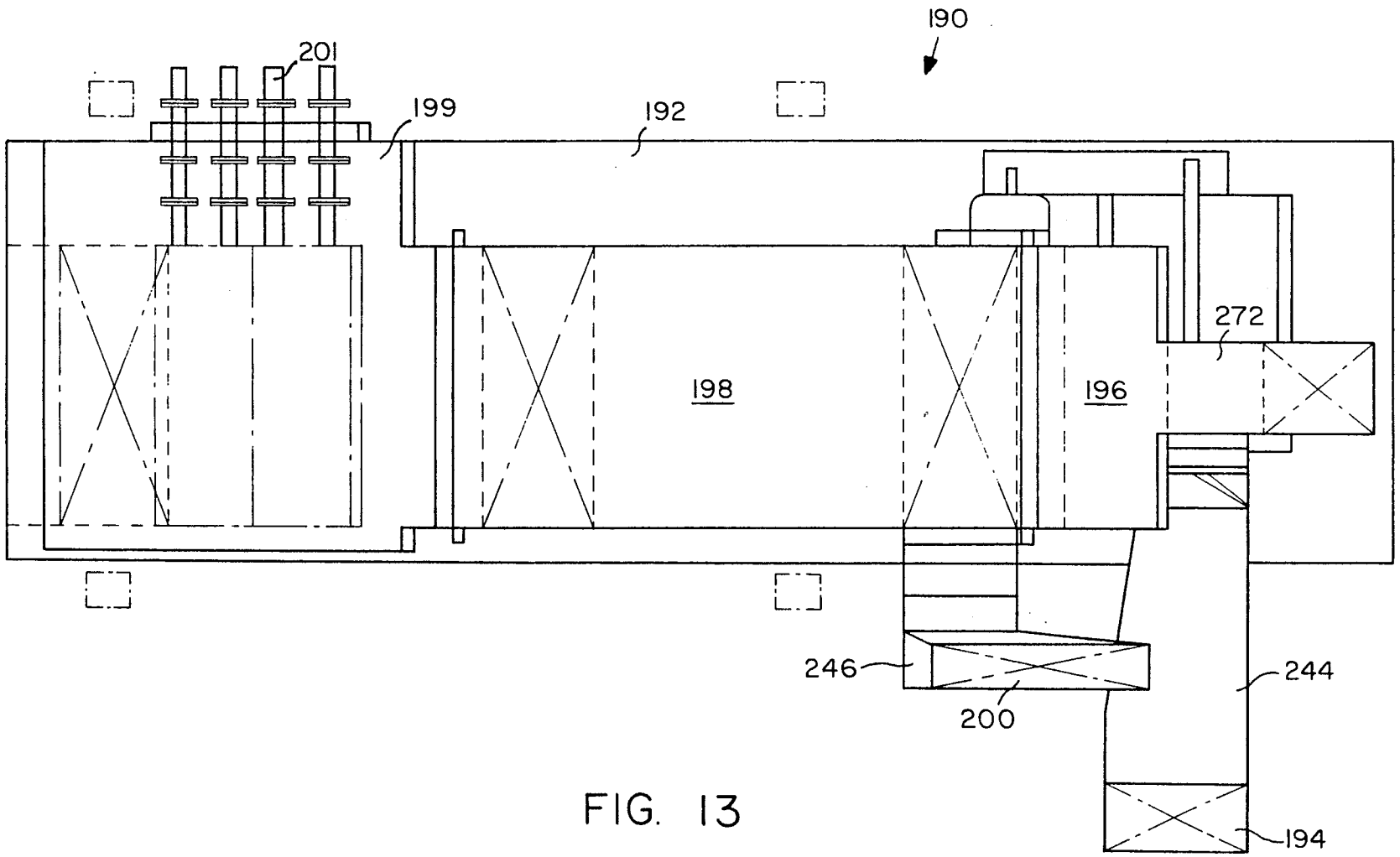
FIG. 13 illustrates a top view of the solvent recovery.

FIG. 13 illustrates a top view of the solvent recovery structure 190 including a recovery platform 192, a heating coil 201, and a fan 196.

MODE OF OPERATION

The three zoned cylindrical dryer is controlled by a control system, such as that disclosed in the referenced co-pending patent application. The substance of the control is to sense the oxygen level and/or the explosive limit, and to maintain the oxygen or solvent level at a predetermined level. Nitrogen or other inert gas is added to maintain an inert atmosphere, and maintain the pressure of the system while the vapors, such as solvent vapors, are condensed in the first two zones and filtered through a carbon bed as exhaust in the third zone. The atmosphere temperature in each zone can be monitored. The supply velocity (static pressure) of the top and bottom air bars in each zone can also be monitored.

Various modifications can be made to the present invention without departing from the apparent scope hereof.

We claim:

1. Dryer comprising:

a. a sealable cylindrical housing having a longitudinal axis and having slotted ends to permit a traveling web of material to pass therethrough along said longitudinal axis;

b. a plurality of partitions within said sealable cylindrical housing sealably positioned transverse to said longitudinal axis whereby said sealable cylindrical housing is divided into a plurality of drying zones;

c. support structure positioned within each of said drying zones of said sealable cylindrical housing for supporting said web; and, d. means responsively coupled to at least one of said zones for supplying said zone with treated and pressurized atmosphere.

2. Dryer comprising:

a. a sealable cylindrical housing having a longitudinal axis and having slotted ends to permit a traveling web of material to pass therethrough along said longitudinal axis;

b. a plurality of partitions within said sealable cylindrical housing sealably positioned transverse to said longitudinal axis whereby said sealable cylindrical housing is divided into a plurality of drying zones;

c. a plurality of opposing air bars positioned within each of said drying zones of said sealable cylindrical housing for flotation of said web; and, d. means responsively coupled to at least one of said plurality of opposing air bars for supplying said air bars with treated and pressurized atmosphere.

3. Dryer of claim 2 wherein said supplying means further comprises a heater for heating said treated and pressurized atmosphere.

4. Dryer of claim 3 wherein said supplying means further comprises a condensing unit for condensing vaporized solvent from said treated and pressurized atmosphere.

5. Dryer of claim 4 wherein said supplying means further comprises a plurality of atmosphere supplies.

6. Dryer of claim 5 wherein each of said plurality of opposing air bars within a given one of said plurality of drying zones is supplied, treated and pressurized with atmosphere from the same one of said plurality of atmosphere supplies.

7. Dryer of claim 6 wherein each of said plurality of atmosphere supplies provides treated and pressurized atmosphere to a different one of said plurality of drying zones.

8. Dryer of claim 7 wherein said slotted ends of said sealable cylindrical housing further comprises an entry seal and exit seal.

9. Dryer of claim 8 wherein said traveling web enters said sealable cylindrical housing via said entry seal and exits said sealable cylindrical housing via said exit seal.

10. Dryer of claim 9 wherein the temperature of said treated and pressurized atmosphere supplied to a given first one of said plurality of drying zones is higher than the temperature of said heated and pressurized atmosphere supplied to a given second one of said plurality of drying zones if said given first one of said plurality of drying zone is closer to said exit seal than said given second one of said plurality of drying zones, and is lower than the temperature of said heated and pressurized atmosphere supplied to said given second one of said plurality of drying zones if said given first one of said plurality of drying zones is closer to said entry seal than said given second one of said plurality of drying zones.

11. Zoned dryer comprising:

a. a sealed cylindrical member including ends and slots to accept a traveling web of material;

b. a plurality of opposing air bars positioned longitudinally in said cylindrical member; and, c. substantially vertical means including web slots positioned in said cylindrical member between each of said opposing air bars and dividing said cylindrical member into mutually sealable drying zones.

12. Zoned dryer of claim further comprising means responsively coupled to said plurality of opposing air bars for supplying treated and pressurized atmosphere to said plurality of opposing air bars.

13. Zoned dryer of claim 12 wherein said supplying means further comprises means for heating said treated and pressurized atmosphere.

14. Process of drying a traveling web through a zoned dryer comprising the steps of:

a. pressurizing to a predetermined set point relative to the atmosphere a cylindrical zoned dryer with an inert gas;

b. positioning opposing air bars in each of zones of said dryer;

c. ducting air through said air bars in each of said zones; and, d. extracting vapors or fluids from the ducted air in each of said zones.

* * * * *